US006923353B2

(12) United States Patent
Texidor

(10) Patent No.: US 6,923,353 B2
(45) Date of Patent: Aug. 2, 2005

(54) BUCKLE RITE WRITE'S CADDY BELT BUCKLE

(76) Inventor: Genaro Texidor, 2606 Hexe Ct., Augusta, GA (US) 30906

( * ) Notice: Subject to any disclaimer, the term of this patent is extended or adjusted under 35 U.S.C. 154(b) by 284 days.

(21) Appl. No.: 10/225,735

(22) Filed: Aug. 21, 2002

(65) Prior Publication Data

US 2003/0085242 A1 May 8, 2003

Related U.S. Application Data

(60) Provisional application No. 60/314,419, filed on Aug. 24, 2001.

(51) Int. Cl.[7] ..... A44B 11/00; F21V 21/08

(52) U.S. Cl. ..... 224/163; 40/640; 40/661.02; 224/681; 224/930; 362/103; 362/118; 362/806

(58) Field of Search ..... 224/163, 681, 224/936; 40/640, 661.02; 362/103, 104, 108, 118, 806

(56) References Cited

U.S. PATENT DOCUMENTS 1,599,920 A * 9/1926 Pryor ..... 224/163
2,854,563 A * 9/1958 Catching ..... 362/104
4,052,773 A * 10/1977 Nesbitt ..... 40/640
4,112,482 A * 9/1978 Powell ..... 362/108
4,170,808 A * 10/1979 Knowles ..... 40/640
4,556,932 A * 12/1985 Lehrer et al. ..... 40/661.02
4,570,308 A * 2/1986 Weisgerber ..... 224/163
4,833,902 A * 5/1989 Mori ..... 206/38
5,275,497 A * 1/1994 Shiau ..... 362/118
5,961,199 A * 10/1999 Lee ..... 362/118
6,056,412 A * 5/2000 Atlee et al. ..... 362/103
6,182,388 B1 * 2/2001 Patton ..... 40/640
6,260,978 B1 * 7/2001 St. John ..... 362/108
6,491,408 B1 * 12/2002 Cooper et al. ..... 362/184

* cited by examiner

*Primary Examiner*—Gary E. Elkins

(57) ABSTRACT

The present invention relates to a belt buckle caddy which stores a set of telescopic pens or pencils which include blinking light reminders when in use to remind the user to place the pens or pencils back in the caddy after use. The caddy also includes a front interchangeable ornament lighted by a glowing or blinking light useful as a safety feature during night walks and to match the users attire. Left and right grooves on the front of the buckle caddy serve to guide the ornament onto the front of the caddy and tubes extending from a top opening on the caddy serve to store the pens or pencils when not in use. Two small holes are formed through the caddy to facilitate holding fixed ornaments or LED electrical contacts which are connected to lithium batteries located on the rear of the caddy.

15 Claims, 2 Drawing Sheets

BUCKLE RITE WRITE'S CADDY BELT BUCKLE

CROSS REFERENCE TO RELATED APPLICATIONS

This application is entitled to the benefit of prior provisional application 60/314,419 filed 24 Aug. 2001.

BACKGROUND AND BRIEF SUMMARY OF THE INVENTION

The present invention relates to a belt buckle caddy which stores a set of telescopic pens or pencils in tubes self contained within the belt buckle. The pens or pencils include blinking light reminders when in use to remind the user to replace the pens or pencils within the belt buckle caddy when not in use. The telescopic pens or pencils are handy for brief writing of a phone number, addresses, etc. and the belt buckle avoids staining of the user's shirt by providing a storage area for the pens or pencils other than a shirt pocket. Also, the blinking light reminder functions as an alarm to prevent loss of the pens or pencils after use.

The invention also relates to a belt buckle caddy which includes an interchangeable front ornament lighted by a glowing or blinking light serving as a safety feature during night walks. The lighted interchangeable ornament allows one to view the ornament night or day and to match a desired ornament to a selected attire. The ornament is mounted using right and left grooves formed on the front of the belt buckle which guide the ornament into position over two small holes in the front of the buckle. The two small holes serve to hold LED electrical contacts connected to lithium batteries on the rear of the buckle. The two small holes can also serve to hold a fixed ornament. A wide variety of belt buckle shapes such as rectangular, oval, round, square, large or small can be used. Also, the belt buckle can be made using plastic or metal.

The combination is useful and desirable. The device serves to enhance the safety of the user at night and provides an aestetically pleasing appearance. The device is also a novelty for disco dancing.

DETAILED DESCRIPTION OF THE DRAWINGS

Figure 1:
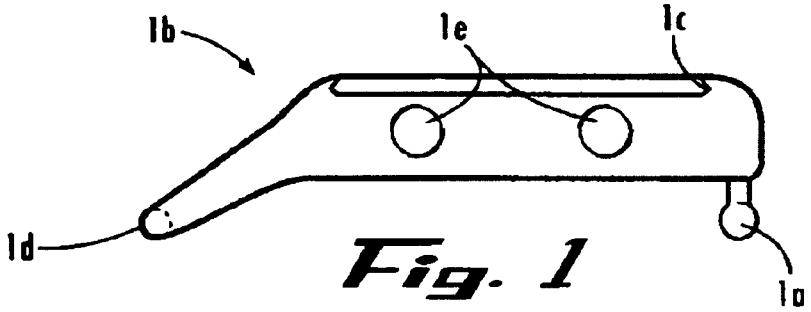
FIG. 1 is a top plan view of the belt buckle.

Referring to FIG. 1, the belt buckle 1*b* includes a nail 1*a* on the right side, a groove 1*c* for slidably receiving an ornament (not shown), a shank end 1*d* for receiving a belt where the belt is placed as indicated by a dotted line and two tubular holes 1*e* for receiving the telescopic pens or pencils.

Figure 2:
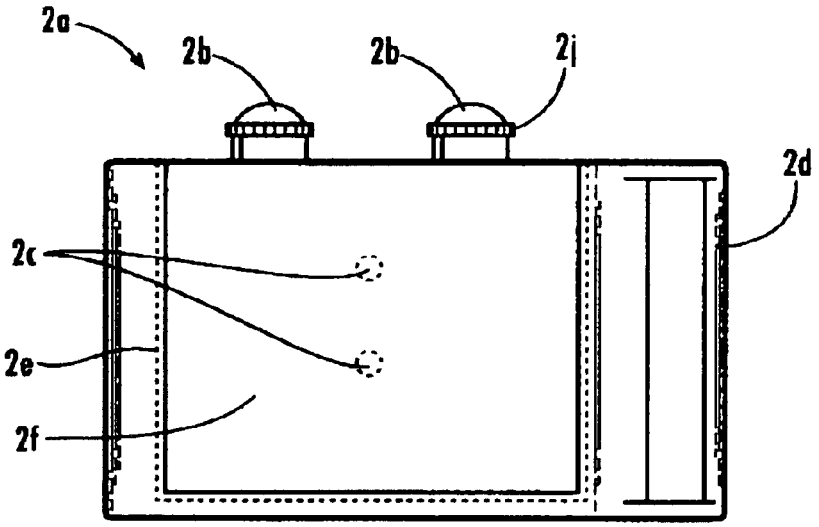
FIG. 2 is a front plan view of the invention showing the belt buckle in combination with the pen or pencils.

FIG. 2 illustrates a front view 2*a* of the device with telescopic pens or pencils positioned in the tubular holes. The telescopic pens or pencils include oval tops 2*b* incorporating LED blinking light reminders and top rims 2*j* which allow the pens or pencils to be easily grasped during removal. Holes 2*c* (depicted in dotted lines) are located behind an interchangeable ornament 2*f* slidably received within the grooves 2*e*. The holes 2*c* are designed to receive LED electrical contacts to facilitate lighting of the ornament. The holes 2*c* can also be used to hold a fixed ornament and can be placed horizontally or vertically as desired for the intended purpose. Interchangeable ornament 2*f* can be formed with any desired design or shape. FIG. 2 also depicts a shank on the buckle where the belt is to be worn.

Figure 3:
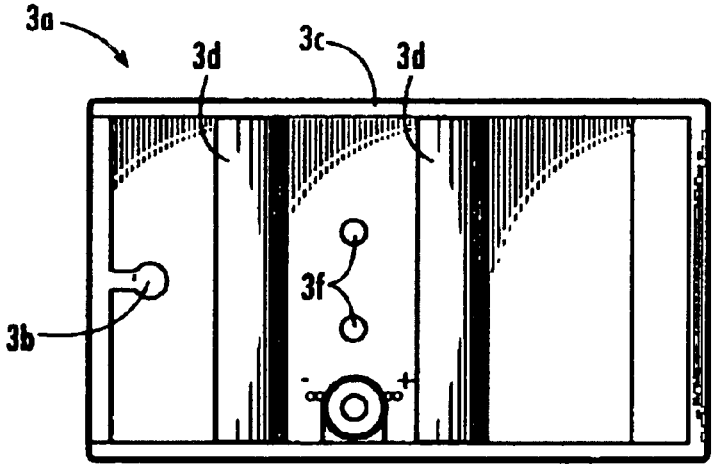
FIG. 3 is a rear plan view of the belt buckle.

FIG. 3 illustrates the belt buckle 3*a* including a nail 3*b*, tubular holes 3*d* for receiving the telescopic pens or pencils, a shank 3*d* for a belt, and holes 3*f* for holding a fixed ornament or LED light contacts. Blinking light wires can be attached to a 3 volt to 12 volt lithium battery positioned in the center upper or lower portion of the buckle. A pressure sensitive switch may also be positioned at the center of the back of the buckle to activate the lights to glow or blink. The shank 3*d* may be variable to be used with different size belts.

Figure 4:
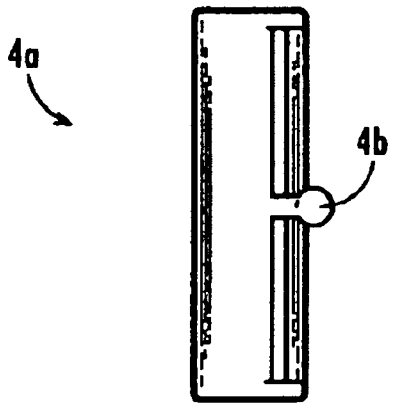
FIGS. 4 and 5 are left side and right side plan views of the belt buckle.

FIG. 4 shows a side view of the buckle 4*a* illustrating the nail 4*b*.

Figure 5:
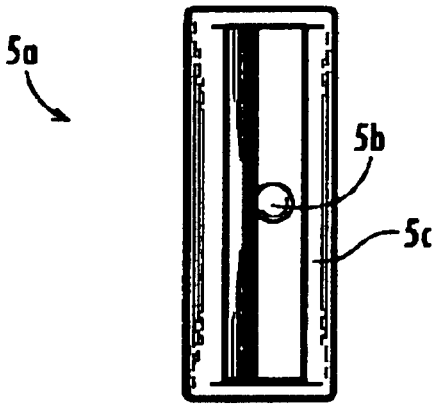

FIG. 5 is an opposite side view of the buckle 5*a* showing the nail 5*b* and the shank 5*c* for belt placement.

Figure 6:
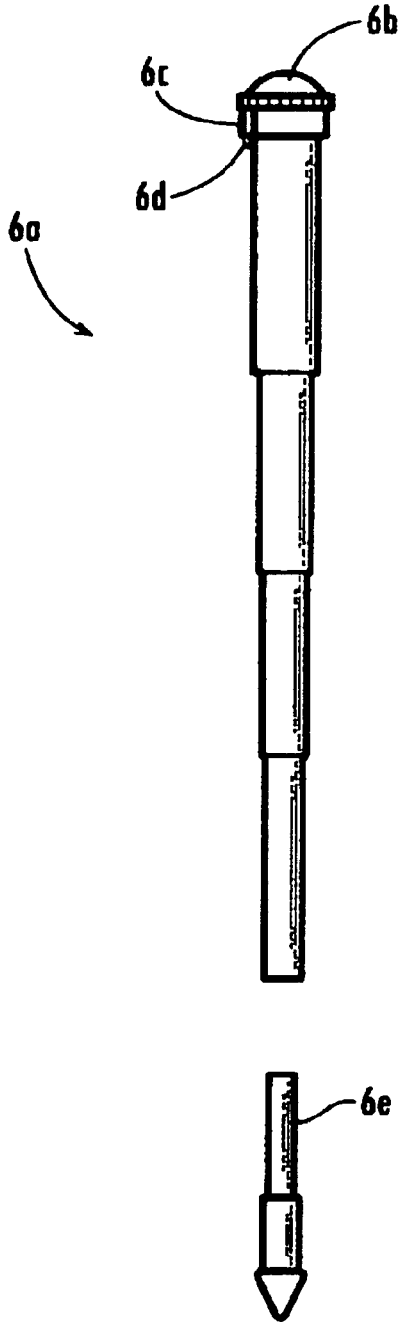
FIG. 6 is an elevational view of one of the telescopic pens or pencils.

FIG. 6 illustrates one of the telescopic pens 6*a* with an oval top light source 6*b*, grasping rim 6*c*, and an inner activation switch 6*d* extending downwardly from the oval top light source 6*b*. Opposite the oval top light source 6*b* is a refill 6*e* for the pen.

With respect to the above description of the invention, it is to be realized that the optimum relationships for the parts of the invention including variations in size, materials, shapes, form, function, manner of operation and manner of assembly and use are deemed readily apparent and obvious to one skilled in the art, and all relationships equivalent to those illustrated in the drawings and described in the specification are intended to be encompasseed by the present invention. Therefor, the foregoing description is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A belt buckle caddy comprising, a belt buckle including a top, bottom, front, and back, two apertures extending through the top of and downwardly into said belt buckle, means for attaching said belt buckle to a belt, two pens or pencils, said pens or pencils each located within one of said apertures, said pens or pencils each including:

a light source visible through the top of said pens or pencils for reminding the user to store the pens or pencils within the belt buckle when not in use, and a switch operatively connected to the light source to automatically activate the light source when the pens or pencils are removed from the belt buckle.

2. The belt buckle caddy of claim 1 wherein said pens or pencils are telescopic pens or pencils.

3. The belt buckle caddy of claim 1 wherein said pens or pencils each include a rim for grasping the pens or pencils for removing the pens or pencils from the belt buckle.

4. The belt buckle caddy of claim 1 wherein said light source is a blinking light source.

5. The belt buckle caddy of claim 1 wherein the belt buckle includes an interchangeable ornament slidably received on the front of the belt buckle.

6. The belt buckle caddy of claim 5 wherein said belt buckle includes an additional light source for lighting the ornament.

7. The belt buckle caddy of claim 6 wherein said additional light source is a blinking light source.

8. A belt buckle caddy comprising, a belt buckle including a top, bottom, front surface, and rear surface, mounting grooves on said front surface framing an area of said front surface, means for attaching said belt buckle to a belt, a removable ornament slidably secured to said mounting grooves and covering said framed area of the front surface, apertures extending through said front surface and said back surface of said belt buckle, a power source connected to said rear surface, a light source on said front surface between said ornament and said front surface for lighting said ornament, connecting elements extending through said apertures and connecting said power source to said light source.

9. The belt buckle caddy of claim 8 wherein said light source is a blinking light source.

10. The belt buckle caddy of claim 8 further comprising an additional ornament allowing the removable ornament and the additional ornament to be interchangeably secured to the caddy as desired.

11. The belt buckle caddy of claim 8 wherein said belt buckle further including two apertures in said top and extending downwardly into the caddy, and two pens or pencils located within said apertures.

12. The belt buckle caddy of claim 11 wherein said pens or pencils include an additional light source visible through the tops of said pens or pencils for reminding the user to store the pens or pencils when not in use, and a switch operatively connected to the additional light source to automatically activate the light source when the pens or pencils are removed from the belt buckle.

13. The belt buckle caddy of claim 12 wherein said additional light source is a blinking light source.

14. The belt buckle caddy of claim 11 wherein said pens or pencils are telescopic pens or pencils.

15. The belt buckle caddy of claim 11 wherein said pens or pencils each include a rim for grasping said pens or pencils for removing said pens or pencils from the belt buckle.

* * * * *